US008827195B2

(12) United States Patent
Gao et al.

(10) Patent No.: US 8,827,195 B2
(45) Date of Patent: Sep. 9, 2014

(54) AUTO PAPER-COMBING MECHANISM AND AN AUTO PAPER-FEEDING MECHANISM OF A PAPER SHREDDER

(75) Inventors: Huigang Gao, Zhejiang (CN); Wujun Wei, Zhejiang (CN)

(73) Assignee: Ningbo Ofitech Business Machines Co., Ltd., Ningbo (CN)

( * ) Notice: Subject to any disclaimer, the term of this patent is extended or adjusted under 35 U.S.C. 154(b) by 0 days.

(21) Appl. No.: 13/699,303

(22) PCT Filed: Mar. 12, 2012

(86) PCT No.: PCT/CN2012/000303

§ 371 (c)(1), (2), (4) Date: Nov. 20, 2012

(87) PCT Pub. No.: WO2013/033966

PCT Pub. Date: Mar. 14, 2013

(65) Prior Publication Data

US 2013/0134244 A1 May 30, 2013

(30) Foreign Application Priority Data

Sep. 5, 2011 (CN) ..... 2011 1 0268321
Sep. 5, 2011 (CN) ..... 2011 1 0268324

(51) Int. Cl.
*B02C 18/00* (2006.01)
*B02C 18/22* (2006.01)

(52) U.S. Cl.
CPC ..... *B02C 18/2225* (2013.01); *B02C 18/0007* (2013.01)
USPC ..... 241/100; 241/222; 241/236

(58) Field of Classification Search
USPC ..... 241/100, 222, 236
See application file for complete search history.

(56) References Cited

U.S. PATENT DOCUMENTS 7,828,235 B2 * 11/2010 Matlin et al. ..... 241/34
7,871,027 B2 * 1/2011 Ko ..... 241/100
8,074,912 B2 * 12/2011 Chang ..... 241/100
8,123,152 B2 * 2/2012 Matlin et al. ..... 241/30
8,146,845 B2 * 4/2012 Chen ..... 241/100
8,201,766 B2 * 6/2012 Chen ..... 241/225
8,439,286 B2 * 5/2013 Pan ..... 241/166

* cited by examiner

*Primary Examiner* — Faye Francis
(74) *Attorney, Agent, or Firm* — Wang Law Firm, Inc.; Li K. Wang; Stephen Hsu

(57) ABSTRACT

An auto paper-combing mechanism of a paper shredder has a frame formed with a feeding channel and a fixing shaft, and a feeding salver. A plurality of combing needle beds are disposed on the fixing shaft; a combing needle is inserted in the bottom of each combing needle bed. The needlepoint of each combing needle heads toward the outlet of the feeding channel, and the height of combing needles are in a ladder-like distribution. The vertical distances between the needlepoint of each combing needle and the lower edge of the outlet of the feeding channel are equal.

15 Claims, 16 Drawing Sheets

AUTO PAPER-COMBING MECHANISM AND AN AUTO PAPER-FEEDING MECHANISM OF A PAPER SHREDDER

CROSS REFERENCE TO RELATED PATENT APPLICATION

The present application is the US national stage of PCT/CN2012/000303 filed on Mar. 12, 2012, which claims the priorities of the Chinese patent application No. 201110268324.X filed on Sep. 5, 2011 and the Chinese patent application No. 201110268321.6 filed on Sep. 5, 2011, which applications are incorporated herein by reference.

FIELD OF THE INVENTION

The present invention relates to a paper shredder, in particular to an auto paper-combing mechanism and an auto paper-feeding mechanism of a paper shredder.

DESCRIPTION OF THE PRIOR ART

The paper shredder is a common office device, which is used for shredding the waste paper. A few pieces of paper can be put in the inlet once by the early paper shredders; but feeding too many pieces may cause a paper jam, even a damage on the paper shredders. For these reasons, when a large quantity of paper needs to be shredded, the pieces of paper have to be fed into the inlet manually for many times, which wastes time and man power, bringing great inconvenience to users. In order to improve the disadvantages, diversified paper shredders with an auto paper combing function are designed, which can be fed with a relatively large quantity of paper in one time. Pieces of paper can be combed automatically by the auto paper combing device, and shred in batches, thus improving the working efficiency of the paper shredder.

For instance, the Chinese Patent Application CN101069869A (Application number: 200710041585.1), discloses an auto paper-combing paper shredder. The top cutter shaft on the upper portion of the paper shredder is formed with an aperture, in which is provided with a cover. A feeding salver is leaning extending under the cover, an auto feeding channel is formed between the feeding salver and the cover. A narrow opening is formed in the bottom end of the feeding salver near the cover, which makes the auto feeding channel narrowed. Thus, after putting a large quantity of paper into the paper feeding channel, only a limited number of paper can be fed through the gap when the paper shredder is working, and the pieces of paper are automatically divided into a plurality of batches to pass through the gap.

For another instance, the Chinese Patent CN201231172Y (Patent Number: ZL20082009561.8) discloses a paper combing and feeding device for the paper shredder. A light-operated transmitting tube and a light-operated receiving tube are respectively provided at two sides of the auto feeding channel; a paper adjusting mechanism matched with a paper guide wheel is provided in the auto feeding channel. Specifically, the paper adjusting mechanism composes of a controlling stop block and a paper adjusting board, one side of the paper adjusting board is connected flexibly to the side wall of the feeding channel, and the other side is tangent to the paper guide wheel. A spring strip is provided between the paper adjusting board and the side wall of the feeding channel, the controlling stop block is vertically fixed on the side wall of the feeding channel. When it is necessary to shred a large quantity of paper, the pieces of paper are put into the auto paper-feeding channel in one time, the feeding of which will block the signal between the light-operated emitting tube and the light-operated receiving tube. Thus, the start-up of the paper shredder drives the rolling of the paper guide wheel. The weight of paper then adjusts the position of the paper adjusting board from the high position to low, and a gap thus forms between the paper adjusting board and the paper guide wheel, which facilitates a few pieces of paper to pass through; when the weight of paper is relatively heavier, which makes the position of the paper adjusting board too low, the stop block will stop the paper from passing through, maintaining the gap for feeding within a certain limit. After the completion of shredding, the light-operated emitting tube and the light-operated receiving tube become optical connection recovered, and the paper shredder stops working.

The auto paper-combing devices of the above two patents are of a relatively simple mechanism, which realizes auto paper-combing preferably. During the operation, however, only after finishing the shredding of the previous batch of paper, then dividing another batch of paper from the rest pieces enters into the gap, that is, the devices can not realize the synchronous combing of a large quantity of paper in one time, therefore leading to relatively low combing efficiency. Moreover, a piece of wrinkled paper may easily result in a paper jam.

In addition, in order to improve the shredding efficiency, lots of present paper shredders are equipped with additional auto paper-feeding mechanisms, which generally adopt rubber rollers rubbing the paper to be shredded directly, and depend on the abrasion force between the rubber rollers and the waste paper for feeding.

For instance, the Chinese Patent CN201470445U (Patent Number: ZL200920134472.0) discloses a paper shredder with an auto paper-feeding device, which comprises an oriented feeding mechanism consisting of a S-shaped guide board and some rubber rollers. The rubber rollers are fixed on the frame through rubber roller shaft, wherein the axis of the rubber roller shaft is horizontal to the plans of the paper-salver board and the paper-blocking board and is provided over the paper-salver board. The rubber rollers fixed on the rubber roller shaft are through the groove of the S-shaped guide board and provided on the upper surface of the paper-salver board parallelly. An outlet for paper to be fed into the shredding blade is formed by the bended part of the extreme end of the S-shaped guide board together with the paper-blocking board. The S-shaped guide board of the paper shredder functions as a certain guidance on the waste paper that enters into the shredding blade, which enhances the reliability of feeding.

For another instance, the Chinese Patent CN201735438U (Patent Number: ZL201220138865.1) discloses an auto paper-feeding mechanism of a paper shredder, which solves the rubbing failure of the present rubber rollers caused by slipping on the waste documents, thus resulting in failure of the technical defects of auto paper-feeding. The auto paper-feeding mechanism of a paper shredder comprises a set of rubber rollers, a paper-salver board and a control spring. The rubber rollers are fixed evenly along the axial direction of the rubber roller shaft fixed on the frame. The radial end surface of the rubber rollers are in camshaft-shape. A movable touching connection with an adjustable gap is adopted by the connection between the rubber rollers and the paper-salver board. The paper-salver board is fixed on the frame though a supporting shaft. The control spring is connected to the feeding end between the frame and the paper-salver board, which forms a flexible connection where the paper-salver board can swing around the supporting shaft under the regulation of the control spring. In this way, through changing the shape of the rubber rollers and the relative position of the paper-salver board, the rubbing position between the rubber rollers and the waste documents and the feeding angle of the waste documents can be changed, thus overcoming the slipping problem of the rubber rollers on the waste documents.

Though there are differences on feeding paper between these two patents, they essentially take advantage of the abrasion force between the rubber rollers and the waste paper to feed paper, which is of a relative low feeding reliability and unstable feeding quantity. Paper jams or less desired quantity of feeding will often result from the wrinkled paper, which leads to a low working efficiency of the paper shredder. Therefore, the above mentioned auto paper-feeding mechanisms need to be improved further.

SUMMARY OF THE INVENTION

It is a first object of the present invention to provide an auto paper-combing mechanism of a paper shredder with a simple mechanism, a synchronous combing function, and a relatively high combing efficiency.

It is a second object of the present invention to provide an auto paper-feeding mechanism of a paper shredder with a high feeding reliability, which can realize feeding the paper in batches.

For achieving the first object, the auto paper-combing mechanism of a paper shredder, comprises a frame which is formed with a feeding channel, and a feeding salver disposed on the frame;

characterized in that: a fixing shaft is disposed on the frame, the axial direction of which runs parallel to the lower edge of the outlet of the feeding channel; a plurality of combing needle beds are disposed on the fixing shaft along the axial direction in sequence, a combing needle is respectively inserted on the bottom of each combing needle bed, the needlepoint of each combing needle heads towards the outlet of the feeding channel, and the height of combing needles are in ladder-like distribution and along the axial direction of the fixing shaft in sequence, furthermore, the vertical distances between the needlepoint of each combing needle and the lower edge of the outlet of the feeding channel are equal.

Preferably, the vertical distances between two adjacent combing needles are equal, which can therefore ensure that some pieces of paper are divided almost equivalently, then maintaining the roughly equal pieces of paper for every shredding.

Multiple mechanisms can be adopted for the combing needle beds. Preferably, the bottom of each combing needle bed is provided with an inserting seat, and a hole is formed on the bottom of the inserting seat, the height of holes are ladder-like distributed along the axial direction of the fixing shaft in sequence, and the rear end of each combing needle respectively runs through the corresponding hole and is fixed on the corresponding combing needle bed. In this way, as the height of holes are in ladder-like distribution and in sequence, the height of all the combing needles are correspondingly in ladder-like distribution and in sequence as well.

In order to prevent each combing needle from swinging transversely when combing the paper, preferably, a limiting board is fixed between the two sides of the frame, which is provided with a plurality of apertures arranged transversely which are opening downwards and the depths of which are ladder-like arranged in sequence, each combing needle runs through the corresponding aperture, and the body of each combing needle resists against the deepest side of the corresponding aperture. By fixing with the limiting board, when a piece of paper with combing needles inserted moves forward and touches the limiting board, then the limit switch is activated and the combing is completed.

In order to prevent each combing needle from swinging vertically combing the paper, and to maintain the equal vertical distances between two adjacent combing needles for achieving accurate paper-combing, as a preference, a pulling arm is provided on the top of each combing needle bed, each pulling arm can keep each combing needle to resist against the deepest side of the corresponding aperture under the pulling of a tension spring. Therefore, during the combing process, the body of each combing needle resists against the deepest side of the corresponding aperture for further limiting, thus ensuring the accurate combing quantity of batches.

The equal batches of paper are depended on the quantity of combing needle beds and combing needles. The preferable quantity of the combing needle beds and the combing needles are respectively eight. Absolutely, the other quantity may be designed as demanded by the user. Each batch of equal pieces of paper is depended on the vertical distances between every two combing needles, which can be in high efficiency for delivering dozens of pieces in one time.

To keep the smoothness of paper before combing, a paper-pressing board is provided above the rear end of the feeding salver, which can press the paper elastically that enters into the feeding channel. Therefore, when pieces of paper the frond end of which has been neatened are put on the feeding salver and pushed into the paper-pressing board, the paper will be compacting pressed and flattened by the paper-pressing board so as to enter into the combing needles for combing.

For achieving the second object, the present invention to provide an auto paper-feeding mechanism of a paper shredder, which comprises a frame which is formed with a feeding channel and a shredding rollers group, the outlet of the feeding channel is located above the inlet of the shredding rollers group;

characterized in that: a fixing shaft is disposed on the frame, the axial direction of which runs parallel to the lower edge of the outlet of the feeding channel; a plurality of combing needle beds are disposed on the fixing shaft along the axial direction in sequence, which can rotate around the fixing shaft; a combing needle is respectively fixed on each combing needle bed, the height of combing needles are in ladder-like distribution and along the axial direction of the fixing shaft in sequence, and the needlepoint of each combing needle heads towards the outlet of the feeding channel; furthermore, a camshaft running parallel to the fixing shaft is disposed on the frame, a plurality of cams are respectively fixed on the camshaft along the axial direction of the camshaft in sequence and respectively match with each combing needle bed, and each cam, driven by the camshaft, can orderly drive the corresponding combing needle bed to rotate, so as to make the combing needles rotate towards the inlet of the shredding rollers group.

Preferably, each combing needle bed comprises a sleeve arranged around the fixing shaft, a pulling arm disposed on the sleeve extending upwards, an inserting seat disposed on the bottom of the sleeve, and a rotating arm disposed transversally on the sleeve, each combing needle is inserted into the inserting seat, and the needlepoint of each combing needle and the rotating arm respectively locate on the two sides of the sleeve; furthermore, each cam, driven by the camshaft, orderly acts on the bottom surface of the corresponding rotating arm so as to make the corresponding rotating arm rotate upwards, and each pulling arm, under the control of an elastic element, always has a tendency of rotating oppositely against the rotating arm. This mechanism of the combing needle beds is relatively simple, firm and rotates flexible, and the rotating arms can drive the combing needles to rotate directly after rotating. In addition, the elastic elements acted on the pulling arms ensure the combing needle beds to be reset after rotating.

As a preference, a supporting shaft is disposed above the camshaft which runs parallel to the camshaft, both two ends of the camshaft are fixed on the frame, and the elastic element is a tension spring, one end of which is fixed on the pulling arm and the other end of which is fixed on the supporting shaft. In this way, one pulling arm corresponds to one tension spring, and a plurality of tension springs lined up along the axial direction of the supporting shaft to keep in tension status on the corresponding pulling arms all the time, thus ensuring that each combing needle bed can be reset in time after a circulation of shredding.

Further, to form a simpler and stronger mechanism of the combing needle beds, the pulling arm, the inserting seat, and the rotating arm are formed integratively, which are fixed on the sleeve as a whole.

As a preference, each cam is substantially in, which includes side surfaces in circular sector, a peripheral surface in arc-shape, a first end surface and a second end surface, the peripheral surfaces of all the cams locate on one cylinder surface, the area of side surfaces in circular sector of each cam decreases gradually from one end to another end along the axial direction of the camshaft, furthermore, the first end surfaces of all the cams locate on the same surface, while the second end surfaces of all the cams are distributed staggeredly in sequence with the same angle. In this way, when the camshaft rotates a certain degree, the second end surface of a cam will act on the corresponding rotating arm. Accordingly, a combing needle presses the paper below into the inlet of the shredding rollers. Then, the rotating arm paired with the combing needle will be separated from the second end surface of the cam and resist against the circular surface of the cam. The rotating speed of the camshaft is designed reasonably in accordance with the paper-shredding speed, which keeps the shredding process continuously. As the camshaft rotates one cycle, the paper separated by the combing needles in advance will be pressed into the shredding rollers for shredding in sequence.

In order to ensure that the quantities of paper are equal when pressing into the shredding rollers every time, the distances between two adjacent combing needles are equal. In this way, after the paper are divided into a plurality of equal batches by the combing needles, the divided paper, driven by the cams, will be sent into the inlet of the shredding rollers for shredding.

In order to limit the position of the combing needles and keep them in order, preferably, a limiting board is fixed between the two sides of the frame, which is provided with a plurality of apertures arranged transversely which are opening downwards and the depths of which are ladder-like arranged in sequence, each combing needle runs through the corresponding aperture, and the body of each combing needle resists against the deepest side of the corresponding aperture.

As a preference, the quantity of the combing needle beds is 6-10. Accordingly, the quantity of the combing needles and the cams are respectively 6-10 as well.

Compared with the prior art, in the present invention, the combing needles fixed on the combing needle beds, the height of which are in ladder-like distribution and in sequence, can realize auto paper-combing. The whole mechanism is relatively simple. Moreover, as the vertical distances between the needlepoint of each combing needle and the lower edge of the outlet of the feeding channel are equal, so that, the paper can touch the needlepoint of each combing needles at the same time when the paper enters into the feeding channel and closes the combing needles, therefore, the synchronous paper-combing will be realized and the paper-combing efficiency will be increased.

On the other hand, in the present invention, a plurality of cams are respectively fixed on the camshaft along its axial direction in sequence which is disposed on the frame, and the cams respectively match with each combing needle bed which can rotate around the fixing shaft, the needlepoint of each combing needle heads towards the outlet of the feeding channel, each cam can act on the combing needle beds and drive the corresponding combing needle to rotate towards the inlet of the shredding rollers group, wherein each combing needle will rotate in sequence, the combing needle in the lowest position will rotate firstly, the combing needle in the highest position will rotates lastly. Such feeding form will not cause any paper jammed, which is of a relatively higher feeding reliability and greater feeding quantity at single one time. Moreover, it realizes to feeding the paper in batches, therefore, the working efficiency of the paper shredder can be increased.

DETAILED DESCRIPTION OF THE PREFERRED EMBODIMENT

To enable a further understanding of the innovative and technological content of the invention herein refer to the detailed description of the invention and the accompanying drawings below:

FIGS. 1~9 are views of an auto paper-combing mechanism in accordance with a first embodiment of the present invention.

Figure 5:
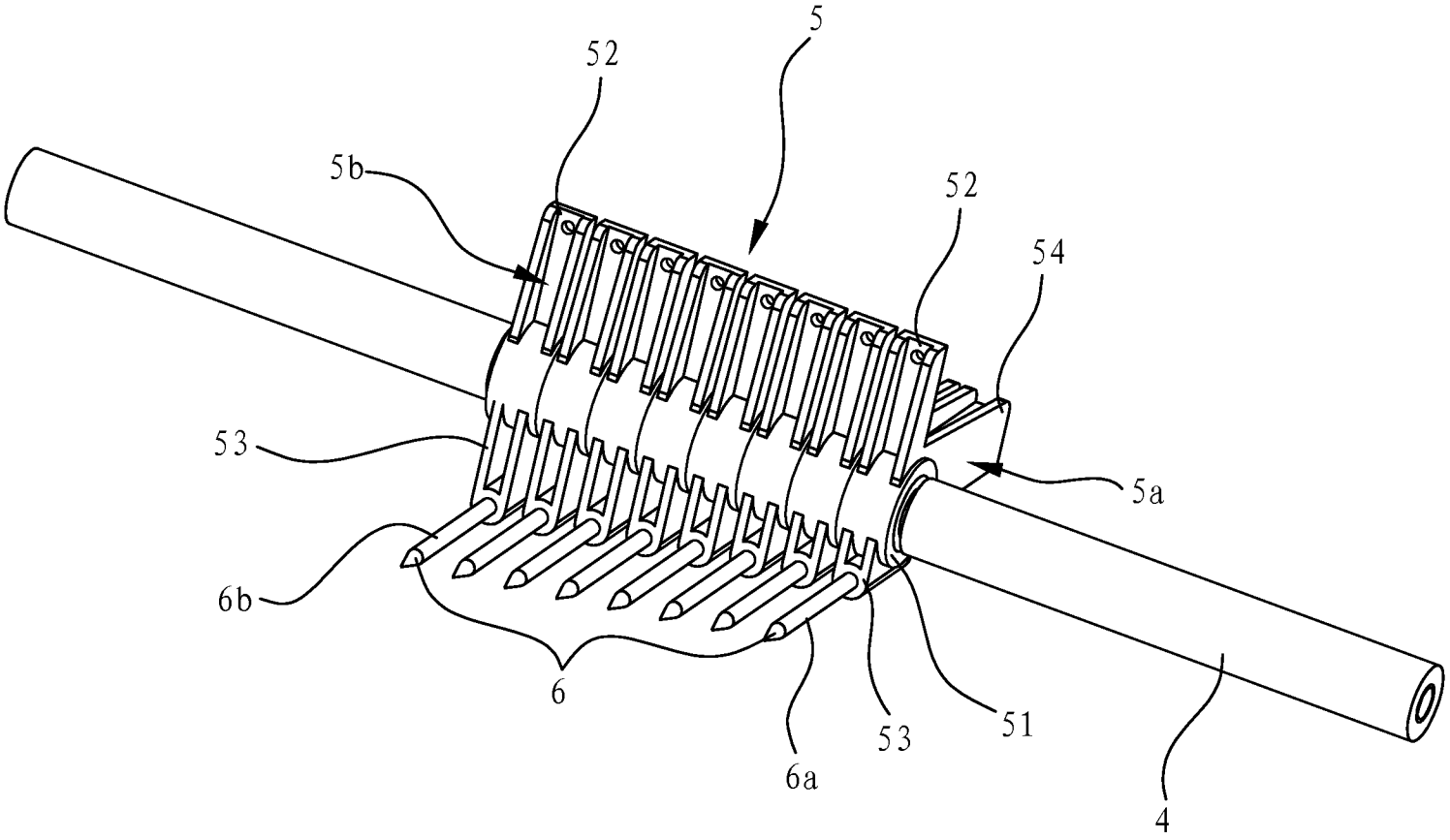
FIG. 5 is a perspective view of the fixing shaft with combing needle beds and combing needles in accordance with the first embodiment of the present invention.
Figure 6:
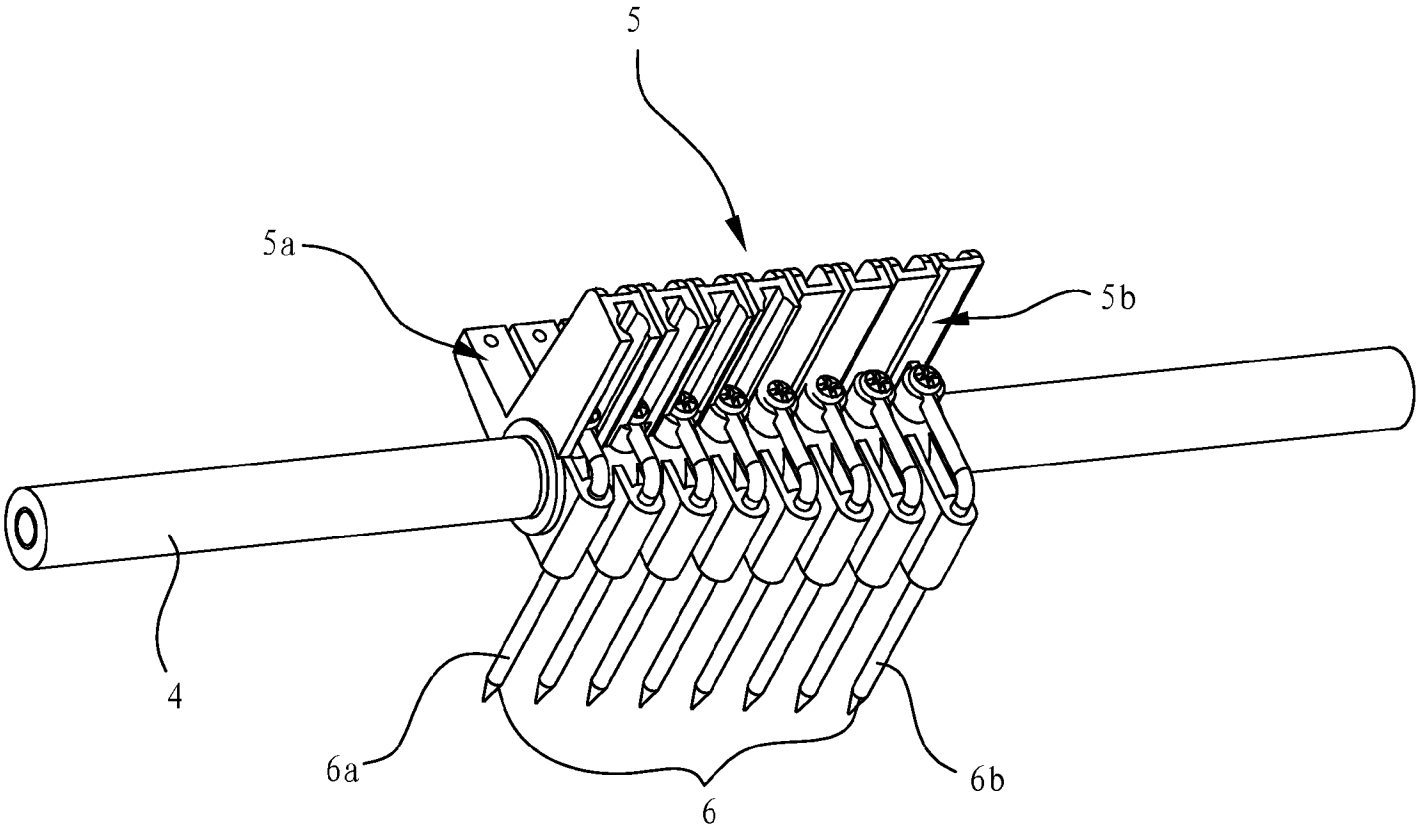
FIG. 6 is another perspective view of fixing shaft with combing needle beds and combing needles as shown in FIG. 5.
Figure 7:
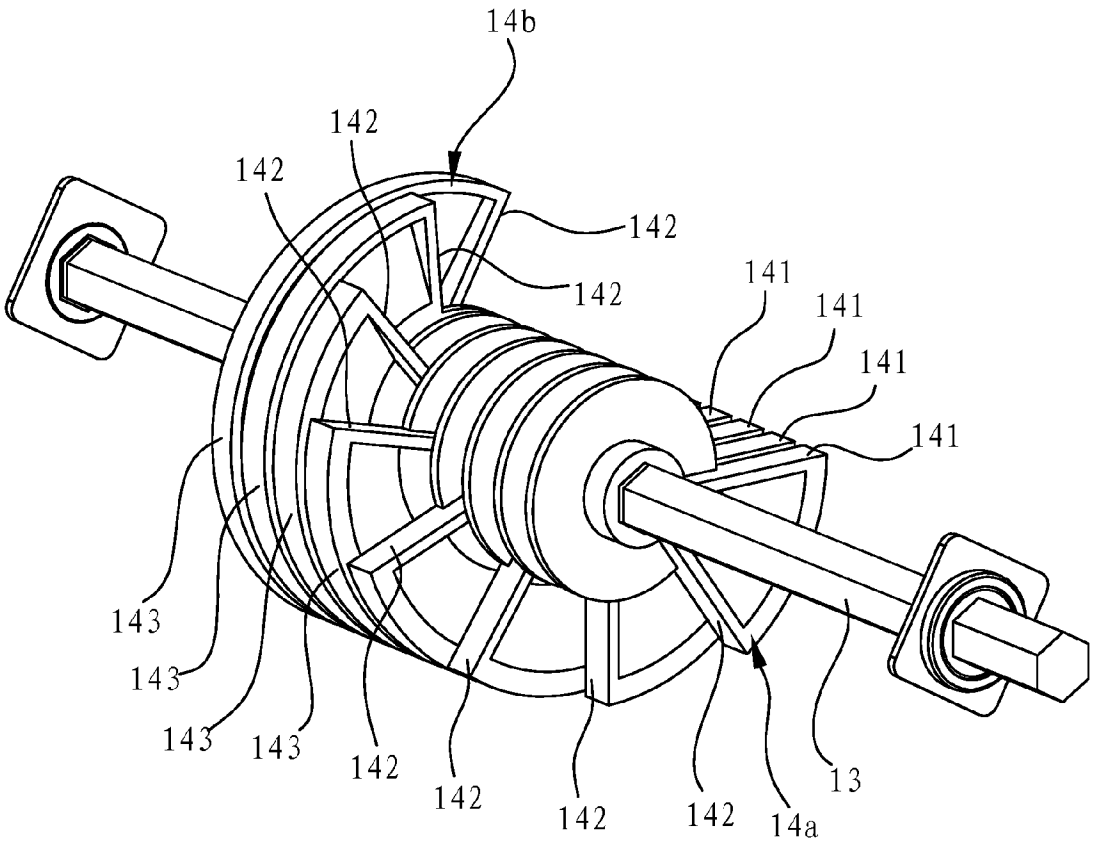
FIG. 7 is a perspective view of the camshaft with the cams in accordance with the first embodiment of the present invention.

The auto paper-combing mechanism of the paper shredder comprises a frame 1 and a feeding salver 2 installed on the frame 1. A feeding channel 3 is formed above the feeding salver 2. A paper-pressing board 10 is provided above the rear end of the feeding salver 2, which has a tend to press downwards under the function of a spring strip. Under the pressure of the paper-pressing board 10, pieces of paper 11 are pressed flat and strong between the feeding salver 2 and the paper-pressing board 10, so as to prepare ready for auto paper-combing. Two ends of a fixing shaft 4 are respectively fixed on the frame 1, with the axial direction of the fixing shaft 4 parallel to the lower edge of the outlet of the feeding channel 3. A plurality of combing needle beds 5 are disposed on the fixing shaft 4 along the axial direction of the fixing shaft 4 in sequence. Generally, the quantity of the combing needle beds 5 can be 6-10. In the embodiment, the quantity of the combing needle beds 5 is eight. Specifically, the combing needle beds 5 consist of a sleeve 51, a pulling arm 52, a inserting seat 53 and a rotating arm 54, wherein the sleeve 51 is arranged around the fixing shaft 4; the pulling arms are disposed on the sleeve extending upwards; the inserting seats 53 are disposed on the bottom of the sleeve 51; and the rotating arms 54 are disposed transversally on the sleeve 51. To form a simpler and stronger mechanism of the combing needle beds 5 of the embodiment, the pulling arm 52, the inserting seat 53 and the rotating arm 54 are formed integratively in the embodiment, which are fixed on the sleeve 51 as a whole. As shown in FIG. 5~FIG. 6, the tops of the inserting seats 53 are set on the same horizontal plane, and their rear ends are in ladder-like distribution and along the axial direction of the fixing shaft 4 in sequence. A hole is formed on the bottom of the inserting seat 53. Accordingly, the combing needles 6 inserted in the combing needle beds 5 are also in ladder-like distribution and along the axial direction of the fixing shaft 4 in sequence. The combing needle 6*a* on the highest position is fixed on the combing needle bed 5*a* in the highest position at the bottom of the inserting seats 53, while the combing needle 6*b* in the lowest position is fixed on the combing needle bed 5*b* in the lowest position at the bottom of the inserting seats 53. Besides, the needlepoint of each combing needle 6 and the rotating arm 54 respectively locate on the two sides of the sleeve 51. The needlepoint of each combining needle 6 heads towards the outlet of the feeding channel 3, while the needlepoint of each combining needle 6 ends pass through the corresponding holes and are fixed on the corresponding combing needle beds 5. In the embodiment, the needlepoint of the combining needles 6 point to a completely opposite direction against the extension direction of the corresponding rotating arms 54. Of course, it is not necessarily to make a completely-opposite direction between the extension direction of the rotating arms 54 and the needlepoint of the combining needles 6 as long as the rotating arms 54 can drive the rotation of the corresponding combing needles 6.

Figure 8:
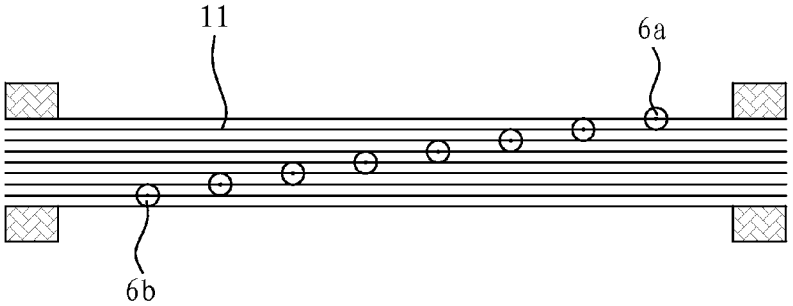
FIG. 8 is a schematic view of a point of the combing needle just touching the paper in accordance with the first embodiment of the present invention.
Figure 9:
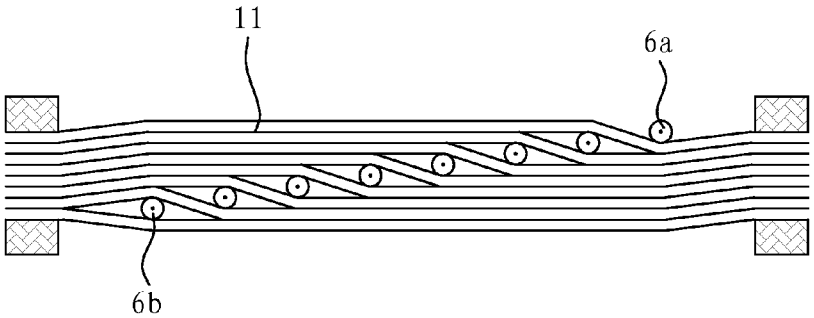
FIG. 9 is a schematic view of a combing needle which completes combing the paper in accordance with the first embodiment of the present invention.
Figure 10:
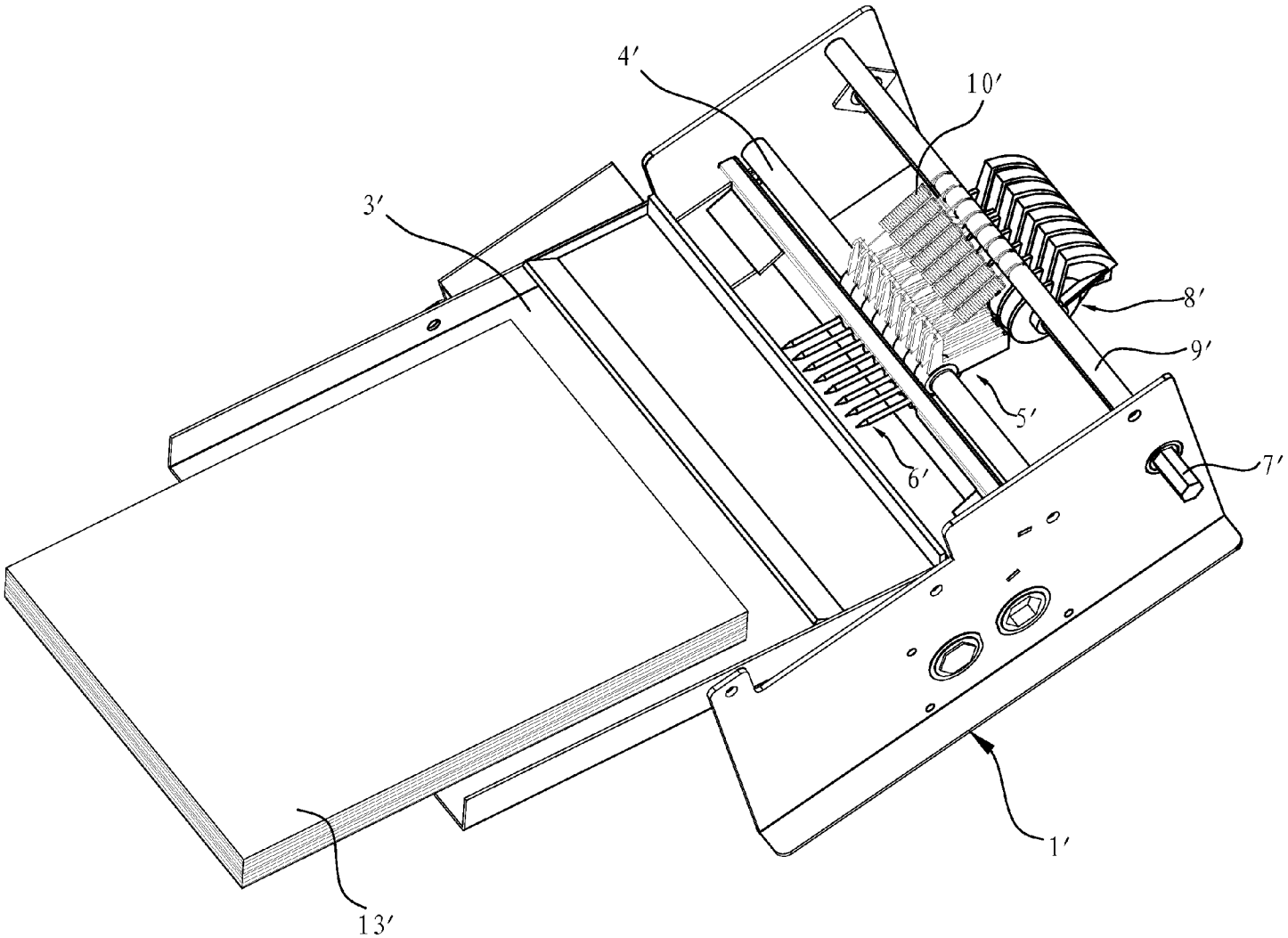
FIG. 10 is a perspective view of an auto paper-feeding mechanism of a paper shredder in accordance with a second embodiment of the present invention.

The needlepoint of each combing needle heads towards the outlet of the feeding channel 3, so the paper 11 can enter into the gap between the combing needles 6 for combing smoothly after coming out from the outlet of the feeding channel 3. Besides, for a rapid and synchronous combing of the paper 11 inside the feeding channel 3, the length of the combing needles 6 is equal, and the vertical distances between the needlepoint of each combining needle 6 and the lower edge of the outlet of the feeding channel 3 are equal as well. In this way, as shown in FIG. 8, when the paper 11 enters into the feeding channel 3 and is pushed around the combining needles 6, the paper 11 may touch the needlepoint of each combining needle 6 synchronously for synchronous combing. Further, for the equal combing of the paper 11, as shown in FIG. 8 and FIG. 9, the vertical distances between the neighboring combing needles 6 are equal. Thus, the quantity of every batch will be roughly kept equal.

In order to prevent each combing needle from swinging transversely when combing the paper, a limiting board 7 is further fixed on the frame 1 to limit the position of the combing needles 6. The limiting board 7 is fixed between the two sides of the frame 1, which is provided with a plurality of apertures 8 arranged transversely which are opening downwards and the depths of which are ladder-like arranged in sequence, and the quantity of the apertures 8 is eight. Each combing needle runs through the corresponding aperture 8, i.e. the combing needle 6*a* in the highest position is inserted into the aperture 8*a* in the highest position of the bottoms. And the combing needle 6*b* in the lowest position is inserted into the aperture 8*b* of the least depth. Therefore, during the combing process, the body of each combing needle 6 resists against the deepest side of the corresponding aperture 8 for further limiting, so as to ensure the accurate combing quantity of batches. Besides, when a piece of paper 11 with combing needles inserted moves forward and touches the limiting board 7, then the limit switch is activated and the combing is completed.

Further, in order to prevent each combing needle 6 from swinging vertically combing the paper, and to maintain the equal vertical distances between two adjacent combing needles 6 for achieving accurate paper-combing, a pulling arm 52 is provided on the top of each combing needle bed 5. Further, to form a simpler and stronger mechanism of the combing needle beds 5, the pulling arm 52, the inserting seat 53 and the rotating arm 54 are formed integratively, which are fixed on the sleeve 51 as a whole. Each pulling arm 52 can keep each combing needle 6 to resist against the deepest side of the corresponding aperture 8 under the pulling of a tension spring 9. One end of the tension spring 9 is fixed on the pulling arm 52, and the other end of the tension spring 9 is fixed on a supporting shaft 12, which has two ends fixed on the frame 1 and runs parallel to the camshaft 4. Therefore, during the combing process, the body of each combing needle 6 resists against the deepest side of the corresponding aperture 8 for further limiting, so as to ensure the accurate combing quantity of batches. In addition, the elastic elements acted on the pulling arms ensure the combing needle beds 5 to be reset after rotating.

Figure 1:
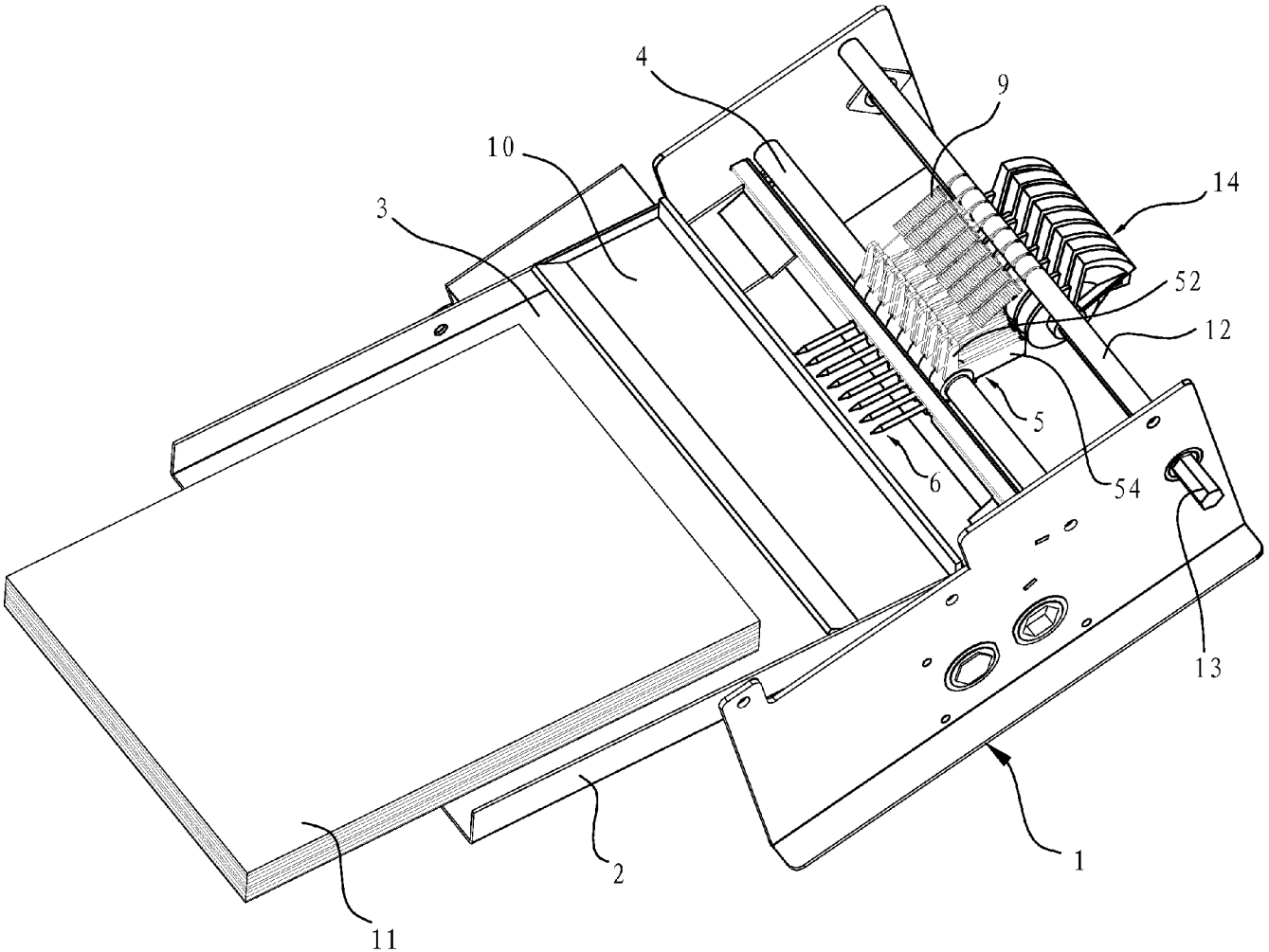
FIG. 1 is a perspective view of an auto paper-combing mechanism of a paper shredder in accordance with a first embodiment of the present invention.

The present invention, during the application, needs to work in coordination with the auto paper-feeding mechanism. The auto paper-feeding mechanism is shown in FIG. 1~FIG.

Figure 2:
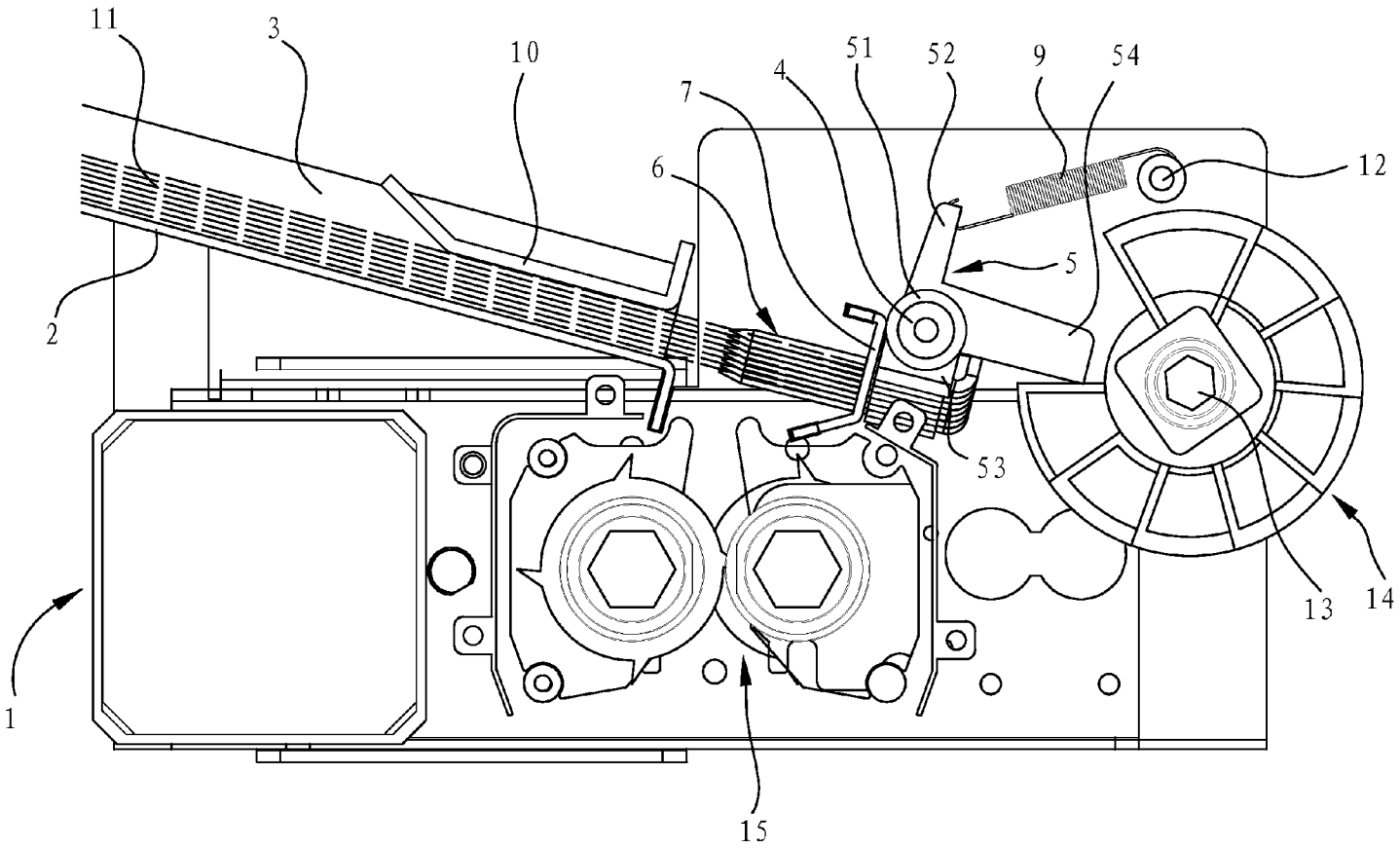
FIG. 2 is a side view of the auto paper-combing mechanism of FIG. 1.
Figure 3:
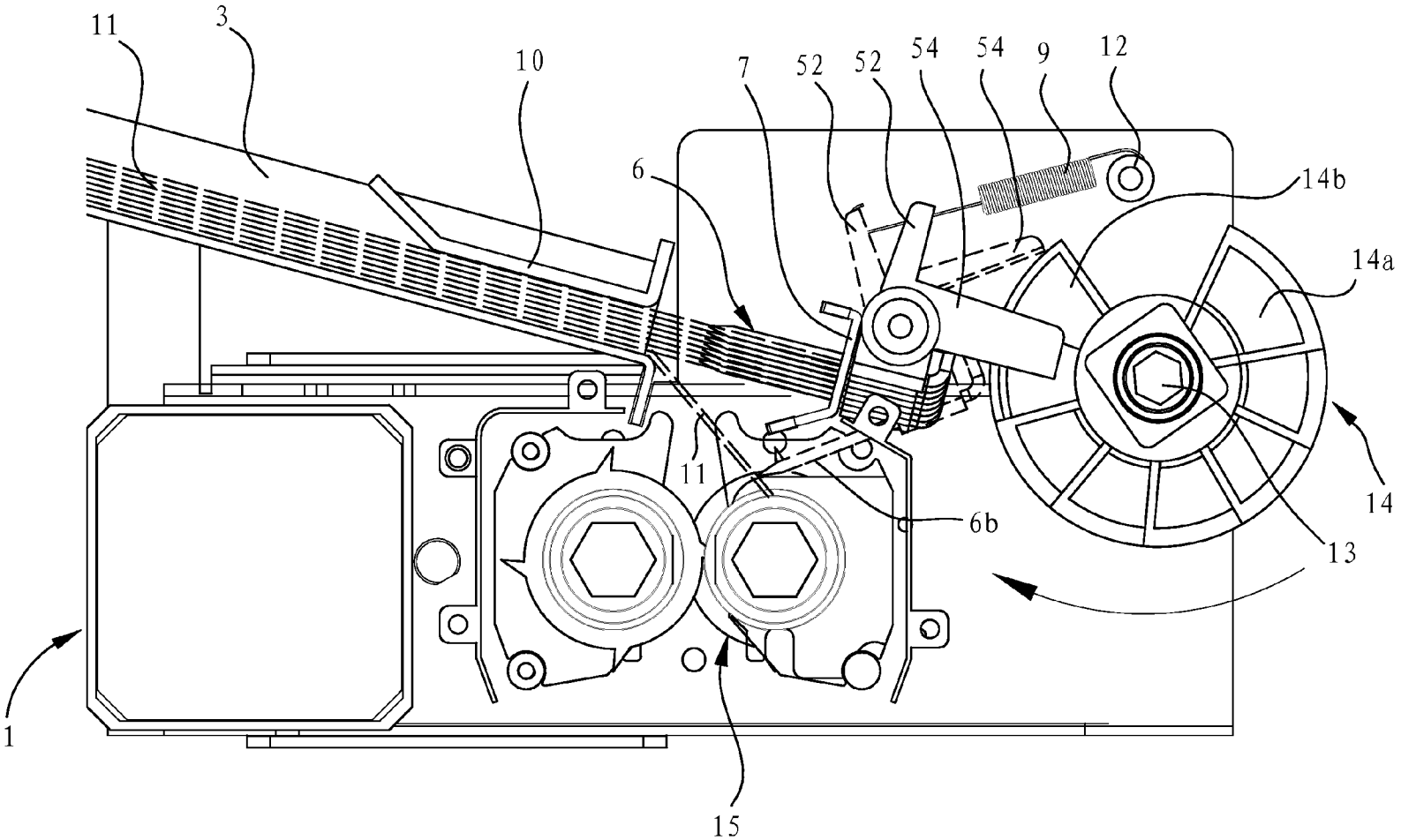
FIG. 3 is another side view of the auto paper-combing mechanism as shown in FIG. 2 when the combing needle beds rotate driven by each corresponding cam.
Figure 4:
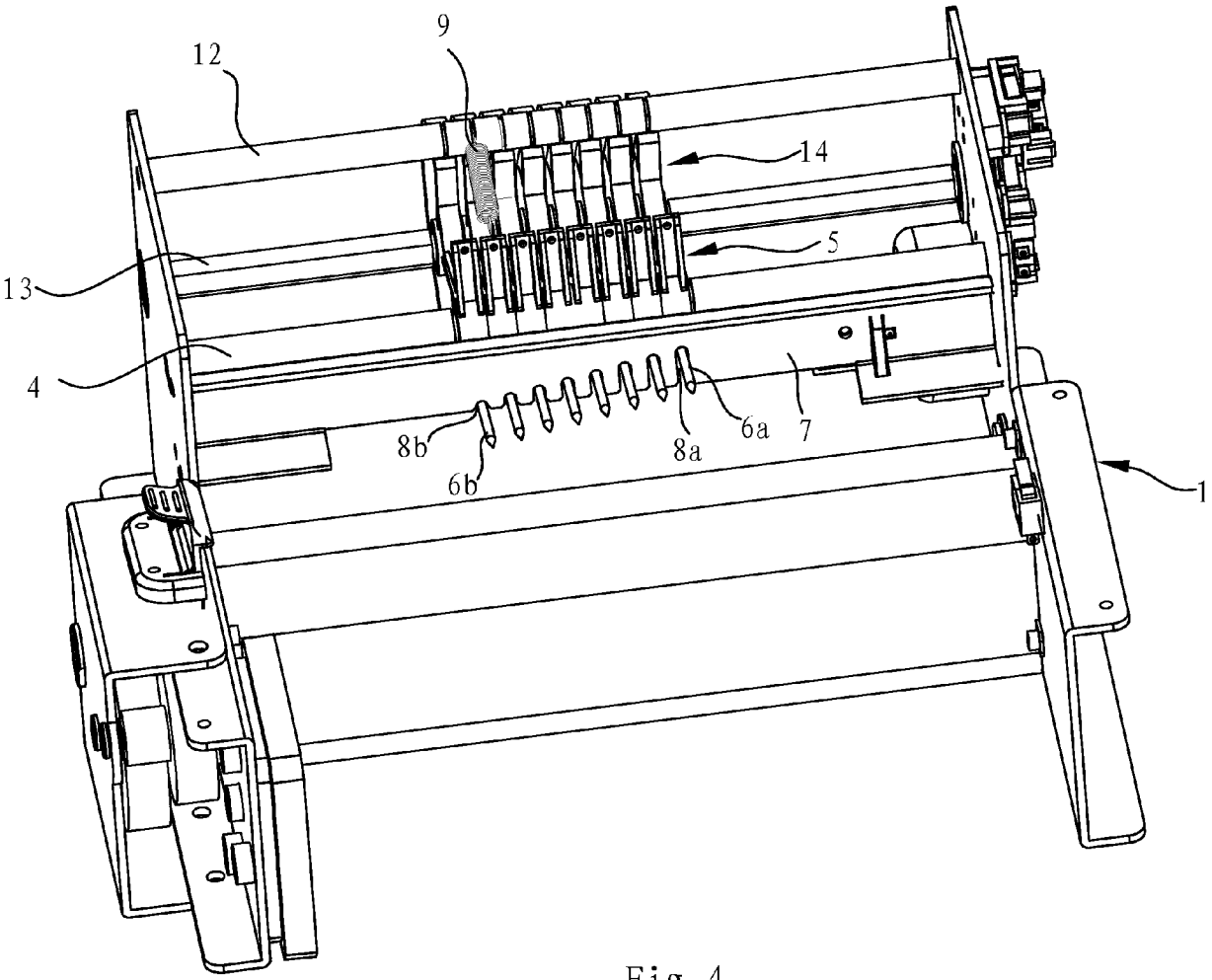
FIG. 4 is another perspective view of the auto paper-combing mechanism as shown in FIG. 1 as some elements omitted.

3 and the work principle may be simplified as follows: A camshaft 13 running parallel to the fixing shaft 4 is disposed on the frame 1, a plurality of cams 14 are respectively fixed on the camshaft 13 along the axial direction of the camshaft 13 in sequence and respectively match with each combing needle bed 5. When the camshaft 13 rotates, the cams 14 push the corresponding rotating arms 54 of the combing needle beds 5 upward, which drive the combing needles 6 to rotate towards the inlet of shredding rollers 15. Thus, the paper 11 below the corresponding combing needles 6 will be sent into the shredding rollers 15 for shredding. Specifically, each cam 14 is substantially in circular sector, a peripheral surface 143 in arc-shape, a first end surface 141 and a second end surface 142, the peripheral surfaces 143 of all the cams 14 locate on one cylinder surface, the area of side surfaces in circular sector of each cam 14 decreases gradually from one end to another end along the axial direction of the camshaft 13, furthermore, the first end surfaces 141 of all the cams 14 locate on the same surface, while the second end surfaces 142 of all the cams 14 are distributed staggeredly in sequence with the same angle. The cams 14 correspond with the combing needle beds 5 one to one. Specifically, the cam 14*b* with the largest sector area corresponds with the combing needle bed 5*b* in the lowest position at the bottoms of the corresponding needle beds 5; in sequence, the cam 14*a* with the smallest sector area corresponds with the combing needle bed 5*a* in the highest position at the bottoms of the corresponding needle beds 5. After the completion of combing, the start status of feeding is shown in FIG. 2. At this moment, the second end face 142 of the cam 14*b* with the largest sector area on the outer side touches the lower end face of the corresponding rotating arm 54. Then, the camshaft 13 starts to rotate, and the cam 14*b* pushes the corresponding rotating arm 54 upwards, thus driving the combing needle 6*b* inserted in the lowest needle bed 5, i.e. the combing needle 6 in the lowest position of the bottoms, to rotate towards the shredding rollers 15. At last, the paper 11 below the combing needle 6*b* is sent into the shredding rollers 15. When the paper 11 is sent to the position shown in FIG. 3, the camshaft 13 stops rotating, and the shredding rollers 15 start to work for shredding of the paper 11. After the completion of shredding, a second batch of feeding begins. The camshaft 13 rotates in the same angle as that of the previous feeding. At this time, the cam 14 next to the cam 14*b* with the largest sector area starts to rotate and drives the combing needle 6 next to the combing needle 6*b* in the lowest position to rotate towards the inlet of the shredding rollers 15. And the likes, the combing needle beds 5 rotate in sequence, driven by the corresponding cam 14, thus driving the corresponding combing needle 6 to rotate towards the inlet of the shredding rollers 15 for feeding. The final feeding is completed by the combing needle 6*a* in the highest position driven by the cam 14*a* with the smallest sector area. In this way, a whole shredding cycle involves 8 feeding processes and 8 shredding processes. After the completion of a shredding cycle, the camshaft 13 rotates right one cycle, and returns to the start status shown in FIG. 2, and the reset switch is activated. The rotation is therefore stopped for the combing of the paper shredder. The fixed angle of rotation by the camshaft 13 in the feeding process is the angle staggered between the second end faces 142 of the cams 14. Compared with the prior art, the camshaft 13 of the embodiment rotates in the angle controlled by a sensor each time, which may realize the fixed-time feeding in batches and improve the work efficiency of the paper shredder significantly. Besides, known form the working principle of the auto paper-feeding mechanism, compared with the prior art taking advantage of the abrasion force between the rubber rollers and waste paper, the feeding form of the embodiment is more reliable, which overcomes the problem of paper jams or a limited feeding quantity less than the rated quantity and thus has a brighter prospect for application.

FIG. 10~FIG. 18 are views of an auto paper-feeding mechanism in accordance with a second embodiment of the present invention.

Figure 14:
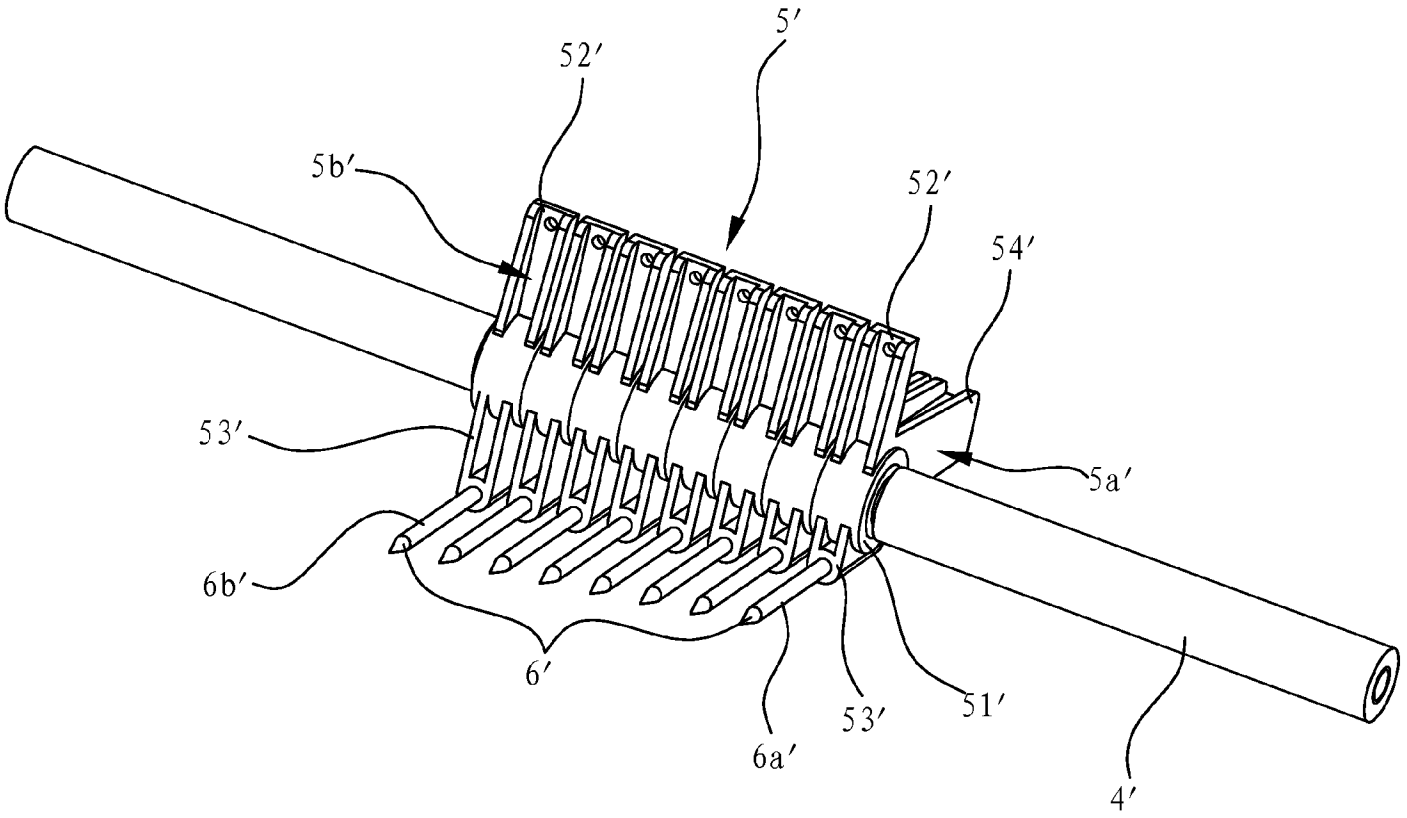
FIG. 14 is a perspective view of the fixing shaft with combing needle beds and combing needles in accordance with the second embodiment of the present invention.
Figure 15:
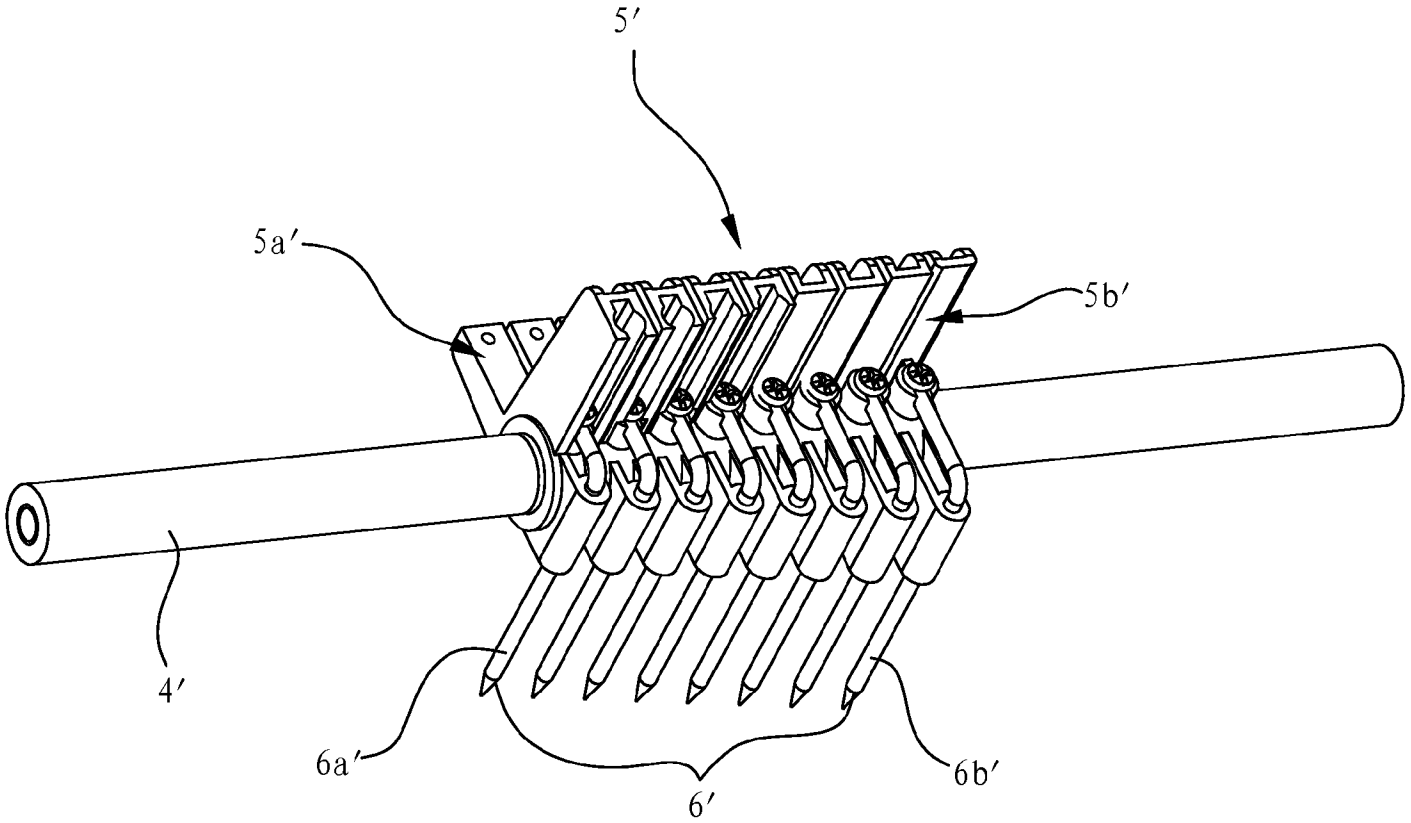
FIG. 15 is another perspective view of the fixing shaft with combing needle beds and combing needles as shown in FIG. 14.
Figure 16:
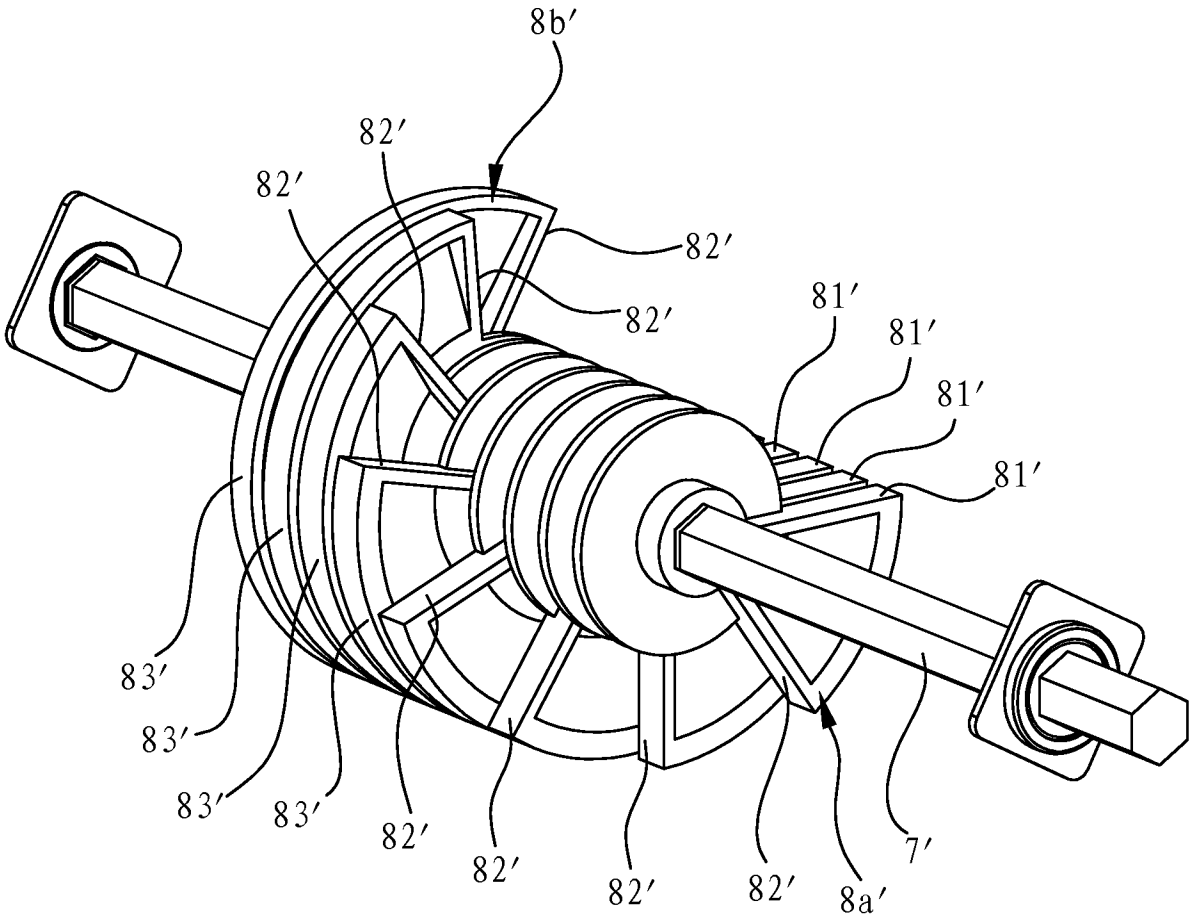
FIG. 16 is a perspective view of the camshaft with the cams in accordance with the second embodiment of the present invention.

The auto paper-feeding mechanism of the paper shredder consists of a frame 1', which is formed with a feeding channel 3' and a shredding rollers group 2', the outlet of the feeding channel 3' is located above the inlet of the shredding rollers group 2'. A fixing shaft 4' is disposed on the frame 1', the axial direction of which runs parallel 3' is located above the inlet of the shredding rollers group 2'. A plurality of the combing needle beds 5' are disposed on the fixing shaft 4' along the axial direction in sequence, which can rotate around the fixing shaft 4'. Generally, the quantity of the combing needle beds 5' may be 6-10, and the quantity of the combing needle beds 5' in the embodiment is 8. Specifically, the combing needle bed 5' consist of a sleeve 51', a pulling arm 52', a inserting seat 53' and a rotating arm 54', wherein the sleeve 51' is arranged around the fixing shaft 4'; the pulling arm 52' is disposed on the sleeve 51' extending upwards; the inserting seat 53' is disposed on the bottom of the sleeve 51'; and the rotating arm 54' is disposed transversally on the sleeve 51'. Further, to form a simpler and stronger mechanism of the combing needle beds 5' of the embodiment, the pulling arm 52', the inserting seat 53' and the rotating arm 54' are formed integratively, which are fixed on the sleeve 51' as a whole. As shown in FIG. 14~FIG. 15, the tops of the inserting seats 53' are set on the same horizontal plane, with their bottom ends distributed vertically in ladder-like distribution in sequence along the axial direction of the fixing shaft 4'. A hole is formed on the bottom of the inserting seat 53'. Accordingly, the height of combing needle 6' runs through the corresponding hole is in ladder-like distribution and along the axial direction of the fixing shaft in sequence. The combing needle 6*a'* on the highest position is fixed on the combing needle bed 5*a'* in the highest position at the bottoms of the inserting seats 53', and the combing needle 6*b'* in the lowest position is fixed on the combing needle bed 5*b'* in the lowest position at the bottoms of the inserting seats 53'. Besides, the front ends of the combing needle and the corresponding rotating arm 54' locate on both sides of the sleeve 51'. The needlepoint of each combing needle 6' heads towards the outlet of the feeding channel 3', and the rear end of each combing needle 6' respectively runs through the corresponding hole and is fixed on the corresponding combing needle bed 5'. In the embodiment, the needlepoint of the combing needle 6' heads to a completely opposite direction against the extension direction of the corresponding rotating arm 54'. Of course, it is not necessarily completely-opposite to the extension direction of the rotating arm 54' as long as the rotating arm 54' drive the rotation of the corresponding combing needles 6'. A camshaft 7' running parallel to the fixing shaft 4' is disposed on the frame 1', and a supporting shaft 9' is disposed above the camshaft 7' which runs parallel to the camshaft 7', both two ends of the camshaft 7' are fixed on the frame 1'. The elastic element in the embodiment is a tension spring 10', one end of which is fixed on the pulling arms 52', and the other end of which is fixed on the supporting shaft 9'. Besides, the tension spring 10' keeps in tension status on the corresponding pulling arms 52' all the time, thus ensuring that each combing needle bed 5' can be reset in time after a circulation of shredding.

Figure 17:
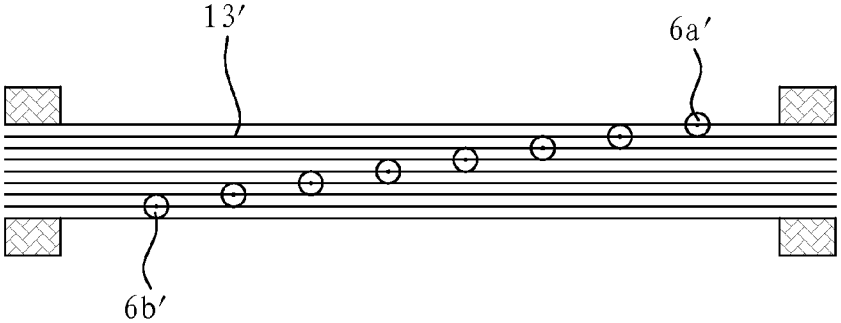
FIG. 17 is a schematic view of a point of the combing needle just touching the paper in accordance with the second embodiment of the present invention.

The paper shredder will complete combing before the operation of its auto paper-feeding mechanism. The working principle of auto paper-combing is shown in FIG. 17~FIG.

Figure 18:
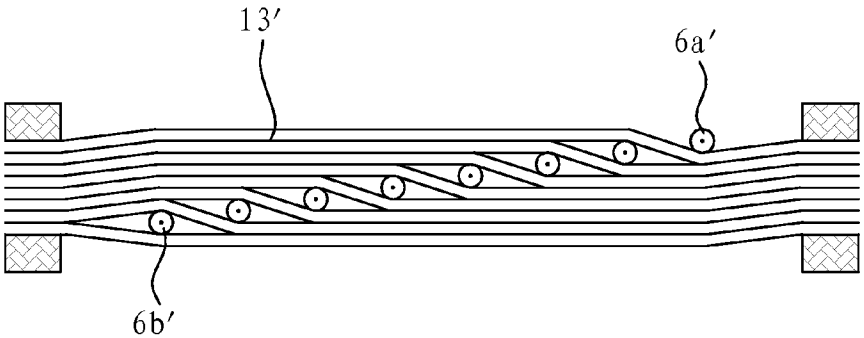
FIG. 18 is a schematic view of a combing needle which completes combing the paper in accordance with the second embodiment of the present invention.

18. As the needlepoint of each combining needle 6' heads towards the outlet of the feeding channel 3', and for synchronous combing, the length of the combing needles 6' of the embodiment is equal and the paper may touch the needlepoint of each combining needle 6' synchronously, when a plurality of paper 13' enters into the feeding channel 3' and touches the needlepoint of each combining needle 6', as shown in FIG. 17, the paper 13' is still folded together. After feeding the paper 13' into the machine as shown in FIG. 18, because the height of the combing needle 6' are in ladder-like distribution and along the axial direction of the fixing shaft 4' in sequence, the folded paper 13' is divided into batches and inserted under the combing needles 6'. In the embodiment, the vertical distances between two adjacent combing needles 6' are equal. Therefore it can be ensured that the quantity of paper 13' is divided by the combing needles 6' almost equivalently.

Figure 13:
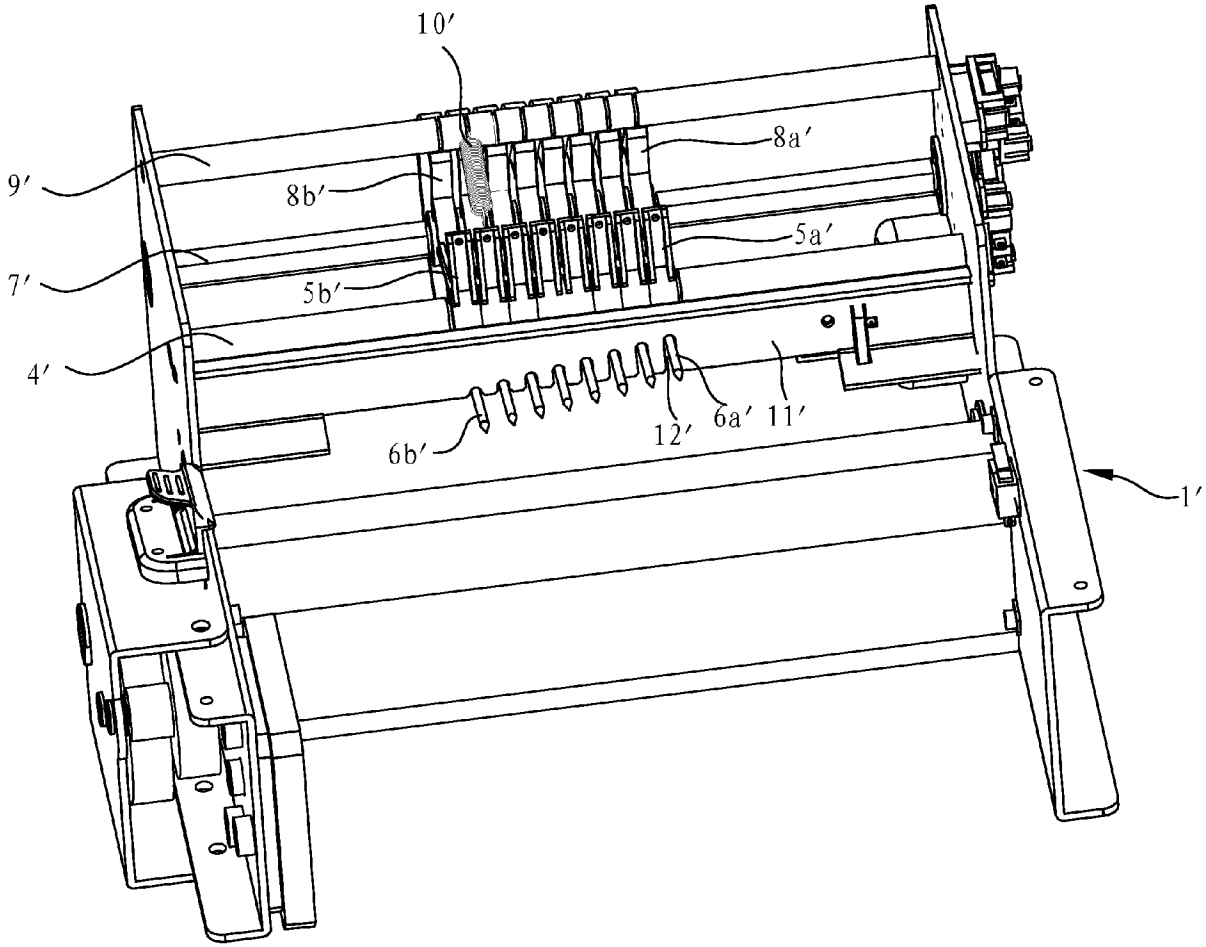
FIG. 13 is another perspective view of the auto paper-feeding mechanism as shown in FIG. 10 as some elements omitted.

As shown in FIG. 13, in order to limit the position of the combing needles 6', a limiting board 11' is set along the axial direction of the fixing shaft 4', both ends of which are fixed between the two sides of the frame 1'. The limiting board 11' provides with a plurality of apertures 12' arranged transversely which are opening downwards and the depths of which are ladder-like arranged in sequence, each combing needle 6' runs through the corresponding aperture 12', i.e. the combing needle 6*a'* in the highest position is inserted into the apertures 12' in the highest position of the bottoms, and the combing needle 6*b'* in the lowest position is inserted into the apertures 12' in the lowest position of the bottoms. Besides, before the shredding rollers 2' rotate towards the inlet, the needle rods of the combing needles 6' touch on the bottoms of the corresponding apertures 12'. Furthermore, when the paper 13' is inserted into the combing needles 6' and touches the end face of the limiting board 11' with the apertures 12' opened, the limit switch is activated and the combing is completed.

Figure 11:
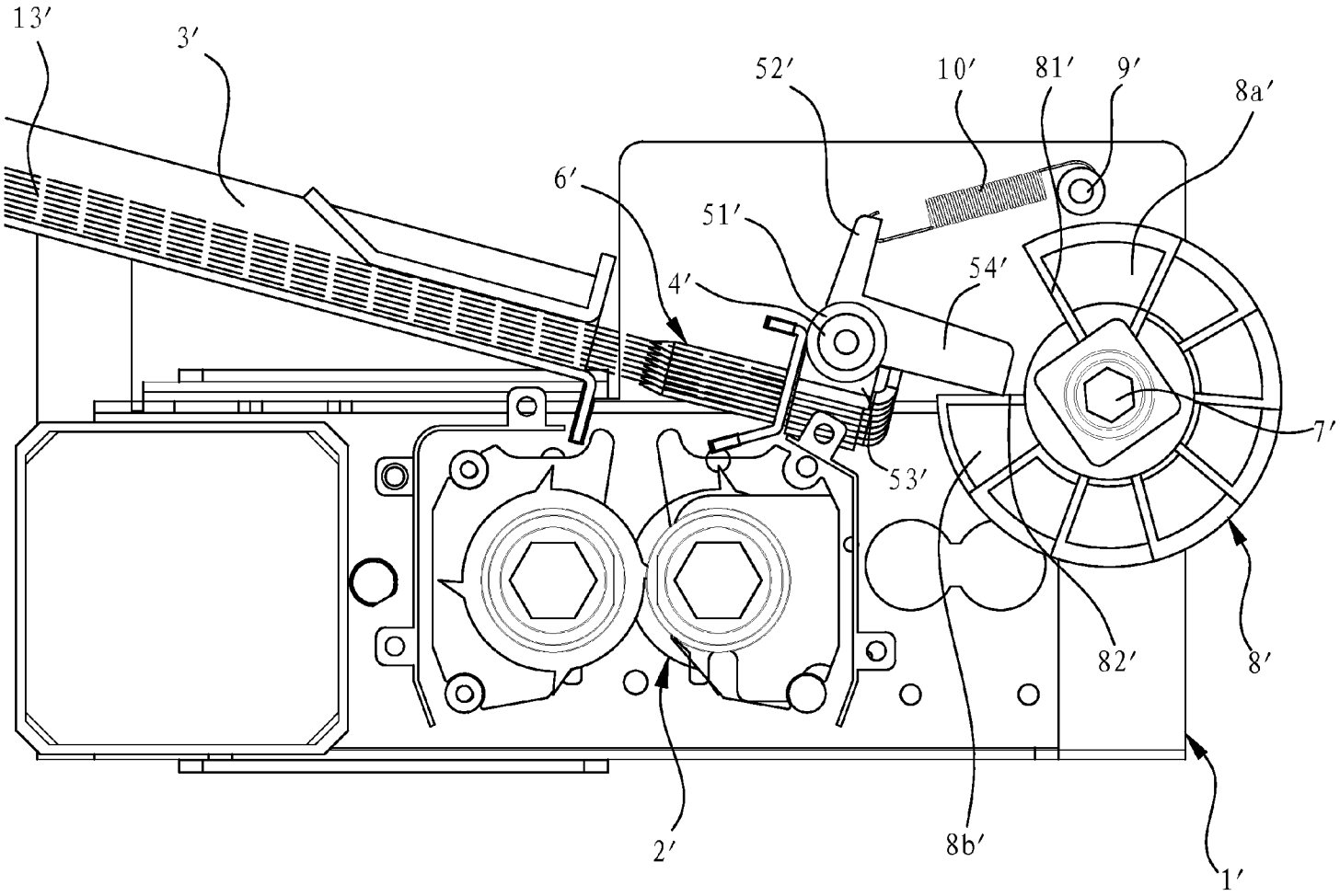
FIG. 11 is a side view of the auto paper-feeding mechanism of FIG. 10.
Figure 12:
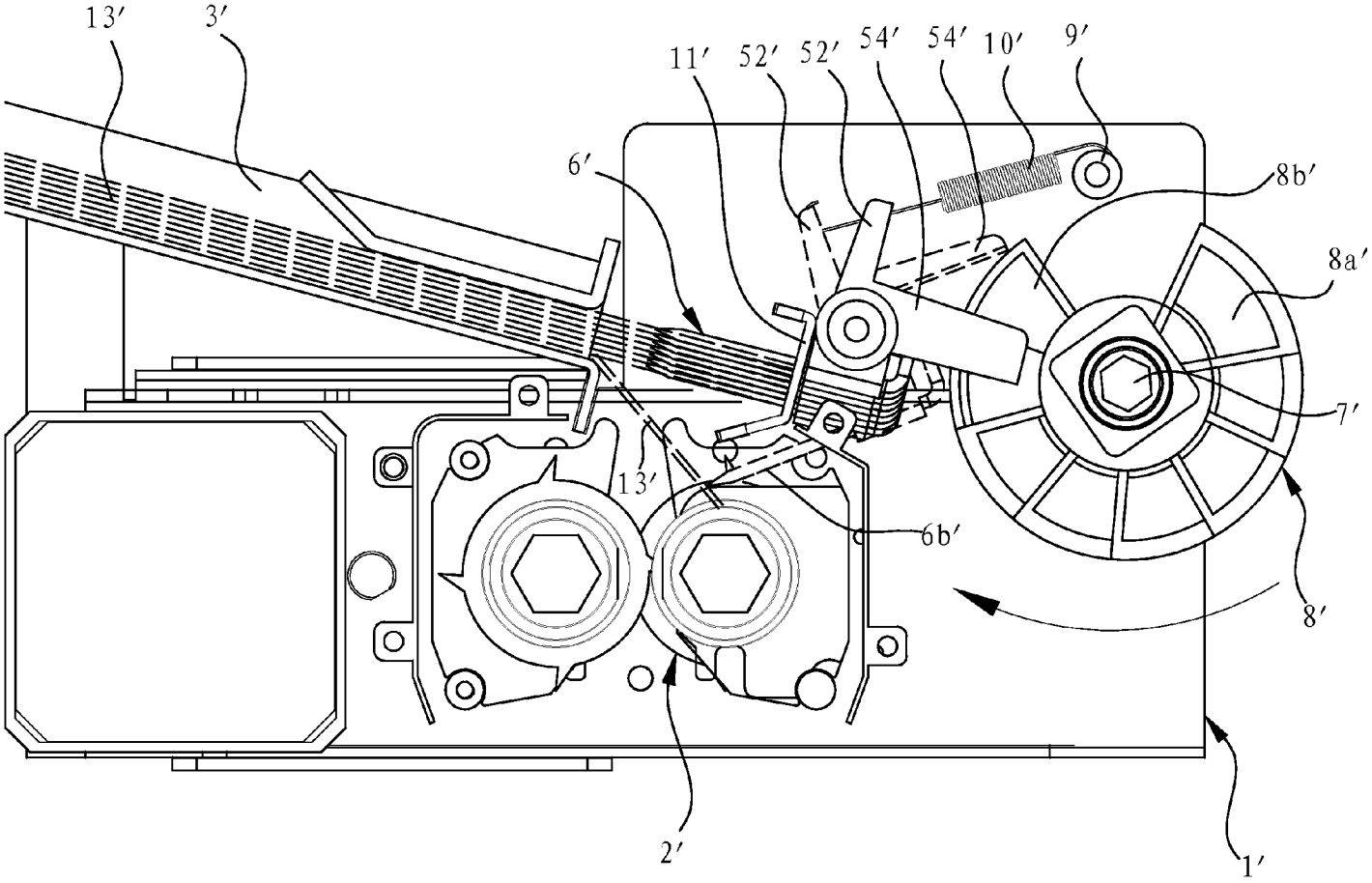
FIG. 12 is another side view of the auto paper-feeding mechanism as shown in FIG. 11 when the combing needle beds rotate driven by each corresponding cam.

The working principle of the auto paper-feeding mechanism may be simplified as follows: 8 cams 8' are fixed on the camshaft 7' in sequence along the axial direction. Each cam 8' is substantially in, which includes side surfaces in circular sector, a peripheral surface 83' in arc-shape, a first end surface 81' and a second end surface 82', the peripheral surfaces 83' of all the cams 8' locate on one cylinder surface, the area of side surfaces in circular sector of each cam 8' decreases gradually from one end to another end along the axial direction of the camshaft 7', furthermore, the first end surfaces 81' of all the cams 8' locate on the same surface, while the second end surfaces 82' of all the cams 8' are distributed staggeredly in sequence with the same angle. The cams 8' correspond with the combing needle beds 5' one to one. Specifically, the cam 8*b'* with the largest sector area corresponds with the combing needle bed 5*b'* in the lowest position at the bottoms of the corresponding needle beds 5'; in sequence, the cam 8*a'* with the smallest sector area corresponds with the combing needle bed 5*a'* in the highest position at the bottoms of the corresponding needle beds 5'. After the completion of combing, the start status of feeding is shown in FIG. 11. At this moment, the second end face 82' of the cam 8*b'* with the largest sector area on the outer side touches the lower end face of the corresponding rotating arm 54'. Then, the camshaft 7' starts to rotate, and the cam 8*b'* pushes the corresponding rotating arm 54' upwards, thus driving the combing needle 6*b'* inserted in the lowest needle bed 5', i.e. the combing needle 6' in the lowest position of the bottoms, to rotate towards the shredding rollers 2'. At last, the paper 13' below the combing needle 6*b'* is sent into the shredding rollers 2'. When the paper 13' is sent to the position shown in FIG. 12, the camshaft 7' stops rotating, and the shredding rollers 2' starts to work for the shredding of the paper 13'. After the completion of shredding, a second batch of feeding begins. The camshaft 7' rotates in the same angle as that of the previous feeding. At this time, the cam 8' next to the cam 8*b'* with the largest sector area starts to rotate and drives the combing needle 6' next to the combing needle 6*b'* in the lowest position to rotate towards the inlet of the shredding rollers 2'. So each combing needle bed 5' rotate in sequence driven by each corresponding cam 8', accordingly to drive each corresponding combing needle 6' to rotate towards the inlet of the shredding rollers 2' for feeding. The final feeding is completed by the combing needle 6*a'* in the highest position driven by the cam 8*a'* with the smallest sector area. In this way, a whole shredding cycle involves 8' feeding processes and 8' shredding processes. After the completion of a shredding cycle, the camshaft 7' rotates right one cycle, and returns to the start status shown in FIG. 11, and the reset switch is activated. The rotation is therefore stopped for the combing of the paper shredder. The fixed angle of rotation by the camshaft 7' in the feeding process is the angle staggered between the second end faces 82' of the cams 8'. Compared with the prior art, the camshaft 7' of the embodiment rotates in the angle controlled by a sensor each time, which may realize the fixed-time feeding in batches and improve the work efficiency of the paper shredder significantly. Further, known form the working principle of the auto paper-feeding mechanism, compared with the prior art taking advantage of the abrasion force between the rubber rollers and waste paper, the feeding form of the embodiment is more reliable, which overcomes the problem of paper jams or a limited feeding quantity less than the rated quantity and thus has a brighter prospect for application.

The invention claimed is:

1. An auto paper-combing mechanism of a paper shredder, comprising:

a frame with a feeding channel, and a feeding salver disposed on the frame, the feeding channel having an outlet;

a fixing shaft is disposed on the frame in an axial direction, parallel to a lower edge of the outlet of the feeding channel;

a plurality of combing needle beds disposed sequentially on the fixing shaft along the axial direction, each combing needle bed has a bottom and a top;

a plurality of combing needles, each combing needle has a needle point and a rear end, each combing needle being inserted in the bottom of each combing needle bed, the needlepoint of each combing needle heads towards the outlet of the feeding channel, and top of the needlepoint of the plurality of combing needles being distributed sequentially along the axial direction of the fixing shaft, each top of a needlepoint being higher than a top of an adjacent needlepoint except for the top of the needlepoint at a lowest position, vertical distances between the needlepoint of each combing needle and a lower edge of the outlet of the feeding channel (3) being equal.

2. The auto paper-combing mechanism of a paper shredder of claim 1, wherein differences between the top of two adjacent combing needles are equal.

3. The auto paper-combing mechanism of a paper shredder of claim 1, wherein the bottom of each combing needle bed is provided with an inserting seat, and a hole is formed at a bottom of the inserting seat, holes are distributed sequentially along the axial direction of the fixing shaft and distances between a hole and the fixing shaft are progressively reduced, and the rear end of each combing needle is inserted into a corresponding hole and is fixed on a corresponding combing needle bed.

4. The auto paper-combing mechanism of a paper shredder of claim 1, wherein the frame has two sides and a limiting board is fixed between the two sides of the frame, the limiting board is provided with a plurality of apertures with downward openings and each aperture has a height and the plurality of apertures are disposed sequentially with the heights arranged progressively higher, each combing needle slides through a corresponding aperture, and each combing needle resists against a deepest side of a corresponding aperture.

5. The auto paper-combing mechanism of a paper shredder of claim 4, wherein a pulling arm is provided on the top of each combing needle bed, each pulling arm keeps a combing needle to resist against the deepest side of the corresponding aperture under tension of a spring.

6. The auto paper-combing mechanism of a paper shredder of claim 1, wherein number of the combing needle beds and the combing needles are respectively eight.

7. The auto paper-combing mechanism of a paper shredder of claim 1, wherein a paper-pressing board is provided above a rear end of the feeding salver, the paper-pressing board presses paper before the feeding channel.

8. An auto paper-feeding mechanism of a paper shredder, comprising:

a frame formed with a feeding channel with an outlet and a shredding rollers group with an inlet, the outlet of the feeding channel being located above the inlet of the shredding rollers group;

a fixing shaft disposed on the frame in an axial direction, parallel to a lower edge of the outlet of the feeding channel;

a plurality of combing needle beds disposed sequentially on the fixing shaft along an axial direction, the plurality of combing needle beds rotate around the fixing shaft;

a plurality of combing needles, each combing needle having a needlepoint and being fixed on a corresponding combing needle bed, the plurality of combing needles being distributed along the axial direction of the fixing shaft heights of the plurality of combing needles are progressively increased, and the needlepoint of each combing needle heads towards the outlet of the feeding channel;

a camshaft disposed parallel to the fixing shaft;

a plurality of cams fixed sequentially on the camshaft (7') along the axial direction of the camshaft and each cam matching to a combing needle bed, and each cam (8'), driven by the camshaft (7'), rotates a corresponding combing needle bed towards the inlet of the shredding rollers group.

9. The auto paper-feeding mechanism of a paper shredder of claim 8, wherein each combing needle bed comprises a sleeve disposed around the fixing shaft, a pulling arm attached to the sleeve and extending upwardly, an inserting seat attached to a bottom of the sleeve, and a rotating arm attached transversally to the sleeve, each combing needle is inserted into a inserting seat, and the needlepoint of a combing needle and the corresponding rotating arm are located on opposite sides of the sleeve;

each cam, driven by the camshaft, acts on a bottom surface of a corresponding rotating arm and rotates a corresponding rotating arm, and each pulling arm, connected to an elastic element, opposes rotation of the rotating arm.

10. The auto paper-feeding mechanism of a paper shredder of claim 9, wherein a supporting shaft is disposed above the camshaft and parallel to the camshaft, the camshaft has two ends fixed on the frame, and the elastic element is a tension spring with one end fixed on the pulling arm (52') and other end fixed on the supporting shaft (9').

11. The auto paper-feeding mechanism of a paper shredder of claim 8, wherein the pulling arm the inserting seat and the rotating arm are formed integratively.

12. The auto paper-feeding mechanism of a paper shredder of claim 8, wherein each cam includes side surfaces in a circular sector, a peripheral surface in an arc-shape, a first end surface and a second end surface, the peripheral surfaces of all the cams locate on one cylinder surface, area of the side surfaces in the circular sector of each cam decreases gradually from one end to another end along the axial direction of the camshaft, the first end surfaces of all the cams locate on one surface, while the second end surfaces of all the cams are distributed staggeredly in sequence with a same angle.

13. The auto paper-feeding mechanism of a paper shredder of claim 8, wherein distances between two adjacent combing needles are equal.

14. The auto paper-feeding mechanism of a paper shredder of claim 8, wherein the frame has two sides and a limiting board is fixed between the two sides of the frame, the limiting board is provided with a plurality of apertures with downward openings and each aperture has a height and the plurality of apertures are disposed sequentially with the heights arranged progressively higher, each combing needle slides through a corresponding aperture, and each combing needle resists against a deepest side of a corresponding aperture.

15. The auto paper-feeding mechanism of a paper shredder of claim 8, wherein number of the combing needle beds is from 6 to 10.

* * * * *